US011588274B2

(12) United States Patent
Kirschner et al.

(10) Patent No.: US 11,588,274 B2
(45) Date of Patent: Feb. 21, 2023

(54) CONNECTING DEVICE HAVING A PLUG CONNECTOR AND A MATING CONNECTOR

(71) Applicant: MD ELEKTRONIK GmbH, Waldkraiburg (DE)

(72) Inventors: Thomas Kirschner, Muehldorf am Inn (DE); Johannes Eben, Rosenheim (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 0 days.

(21) Appl. No.: 17/406,118

(22) Filed: Aug. 19, 2021

(65) Prior Publication Data

US 2022/0069517 A1 Mar. 3, 2022

(30) Foreign Application Priority Data

Aug. 31, 2020 (DE) ..... 10 2020 122 660.8

(51) Int. Cl.
*H01R 13/627* (2006.01)
*H01R 13/639* (2006.01)

(52) U.S. Cl.
CPC ..... *H01R 13/6272* (2013.01); *H01R 13/639* (2013.01)

(58) Field of Classification Search
CPC ..... H01R 13/6272; H01R 13/639
See application file for complete search history.

(56) References Cited

U.S. PATENT DOCUMENTS 5,234,356 A * 8/1993 Maejima ..... H01R 13/6272 439/352
5,681,178 A * 10/1997 Kunkle ..... H01R 13/641 439/352
5,928,038 A * 7/1999 Berg ..... H01R 13/6272 439/752
6,234,826 B1 * 5/2001 Wilber ..... H01R 13/4368 439/352
6,780,045 B2 * 8/2004 Shuey ..... H01R 13/641 439/352
7,470,138 B1 12/2008 Chen et al.
(Continued)

FOREIGN PATENT DOCUMENTS

DE 102015224164 A1 6/2016
DE 112017001349 T5 11/2018
(Continued)

*Primary Examiner* — Neil Abrams
(74) *Attorney, Agent, or Firm* — Legdit, Voit & Mayer, Ltd.

(57) ABSTRACT

A connecting device includes a plug connector receivable into a receiving space of a mating connector. In a connection position, a latching arm of the plug connector is engaged with a latch receiver of the mating connector. The plug connector has a securing unit for locking and releasing the latching arm. The mating connector has a counterstop element which, when the plug connector is introduced into the receiving space, strikes a deflection chamfer of the securing unit and deflects a securing arm of the securing unit perpendicularly to the direction of insertion and in parallel to a base side of the plug connector so that, in the connection position, a stop surface of the securing unit is arranged at an offset from a stopper element of the securing unit, and the securing unit is movable into a locked position.

18 Claims, 6 Drawing Sheets

(56) References Cited

U.S. PATENT DOCUMENTS

| | | | | |
|---|---|---|---|---|
| 8,926,355 | B2 * | 1/2015 | Heil | H01R 13/641 439/352 |
| 9,054,458 | B1 | 6/2015 | Ng | |
| 10,038,278 | B2 * | 7/2018 | Lane | H01R 13/6272 |
| 10,135,172 | B1 * | 11/2018 | Foltz | H01R 13/6272 |
| 10,135,372 | B2 * | 11/2018 | Gibbs | H02P 1/16 |
| 10,283,904 | B2 * | 5/2019 | Amemiya | H01R 13/641 |
| 10,355,414 | B1 | 7/2019 | Alvarado | |
| 10,673,169 | B2 * | 6/2020 | Jabrane | H01R 13/6272 |
| 10,784,625 | B2 * | 9/2020 | Narama | H01R 13/641 |
| 11,342,708 | B2 * | 5/2022 | Menez | H01R 13/6272 |
| 11,456,553 | B2 * | 9/2022 | Soh | H01R 13/4361 |
| 11,495,906 | B2 * | 11/2022 | Yamamoto | H01R 13/465 |
| 2017/0373435 | A1 | 12/2017 | Denz | |
| 2018/0316132 | A1 | 11/2018 | Holub et al. | |
| 2022/0069517 | A1 * | 3/2022 | Kirschner | H01R 13/641 |

FOREIGN PATENT DOCUMENTS

| | | | |
|---|---|---|---|
| EP | 3089280 | A1 | 11/2016 |
| EP | 2218149 | B1 | 11/2017 |

* cited by examiner

CONNECTING DEVICE HAVING A PLUG CONNECTOR AND A MATING CONNECTOR

CROSS REFERENCE TO RELATED APPLICATIONS

This application claims benefit to German Patent Application No. DE 10 2020 122 660.8, filed on Aug. 31, 2020, which is hereby incorporated by reference herein.

FIELD

The invention relates to a connecting device having a plug connector and a mating connector, in particular for connecting at least one cable to a further electrical component.

BACKGROUND

Plug connector arrangements are generally used for releasably connecting cables, in particular coaxial cables, to an electrical component. Plug connector arrangements normally have contact parts which are connected to the conductive components of the cable in order to establish an electrical connection between the cable and the component to be connected. Furthermore, a plug connector arrangement typically has a housing part for each connection partner. The housing part is mechanically connected either to the component or the cable or to the contact parts. In addition, the housing parts of the connection partners may be releasably connected to one another in order to create an additional connection which, for one thing, protects the conductive connection of the contact parts and the connection of the connection partners becomes more stable and resistant to external influences. If the housing parts are connected by means of a positive fit, for example by means of snap-fit connections, a so-called plug connector position securing system may be necessary, which prevents an undesired or unintentional release of the snap-fit connection. Such plug connector position securing systems are known, for example, from patent specifications U.S. Pat. No. 9,054,458 B1, U.S. Ser. No. 10/355,414 B1 and DE 11 2017 001 349 T5.

However, the plug connector arrangements known from the prior art have the disadvantage that they are very complex in order to meet the demands placed on the plug-in connection.

SUMMARY

In an embodiment, the present disclosure provides a connecting device having a plug connector and a mating connector. The plug connector has a housing which has a plug-in side, a rear side and a base side connecting the plug-in side and the rear side, and a latching arm. The mating connector has a receiving space, wherein, in a connection position, the plug connector is at least partially received, in a direction of insertion, in the receiving space of the mating connector. In the connection position, the latching arm, in a rest position, is engaged with a latch receiver of the mating connector. The plug connector has a securing unit which is movably arranged on the base side between a locked position, in which the securing unit locks the latching arm in the rest position, and a release position, in which the latching arm is movable out of the rest position. The securing unit comprises: a base part and a securing arm extending away from the base part toward the plug-in side; a stop surface which, in the release position, abuts against a stopper element arranged on the base side of the housing so that a movement of the securing unit into the locked position is blocked; and a deflection chamfer at an end facing away from the base part. The mating connector has at least one counterstop element which is configured such that, when the plug connector is introduced into the receiving space, the at least one counterstop element strikes the deflection chamfer and deflects the securing arm perpendicularly to the direction of insertion and in parallel to the base side so that, in the connection position, the stop surface is arranged at an offset from the stopper element and the securing unit is movable into the locked position

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
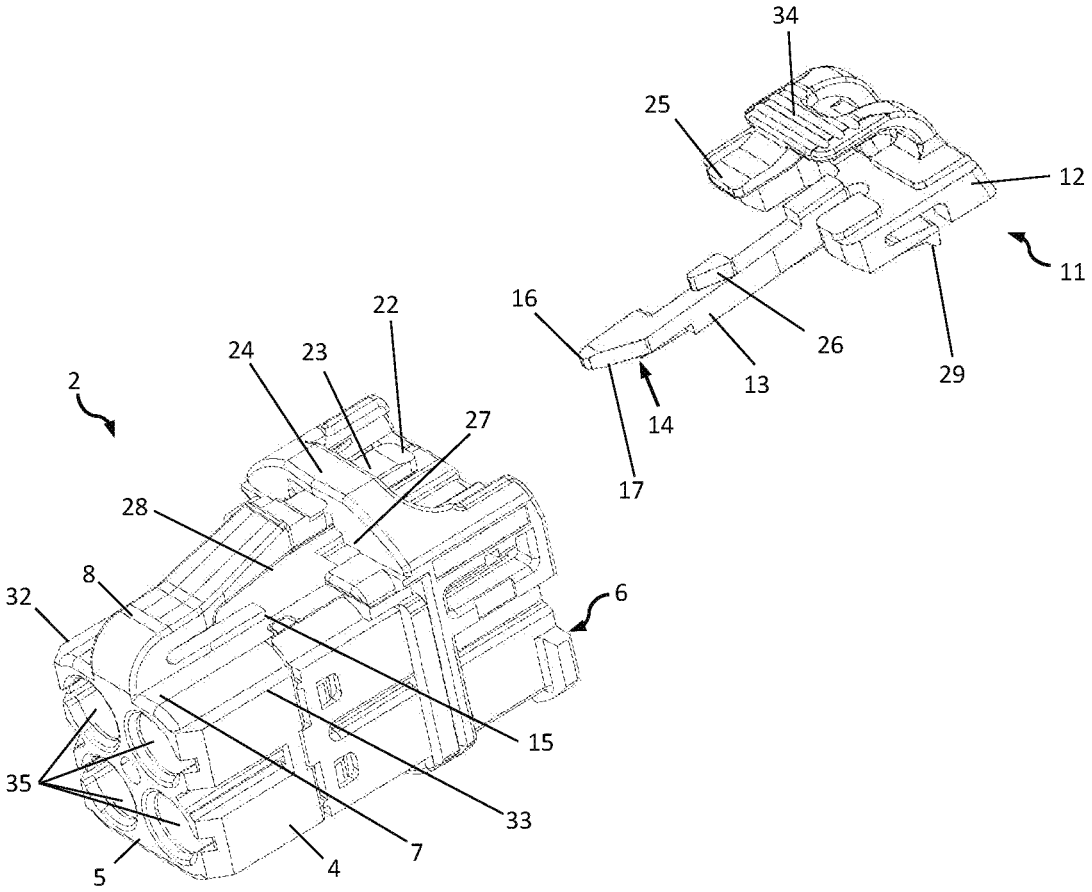
FIG. 1 a first embodiment of a plug connector of a connecting device according to the invention in an exploded view.

In an embodiment, the present invention provides a connecting device which comprises an improved plug connector position securing system that has a significantly lower degree of complexity.

A connecting device according to an embodiment of the invention comprises a plug connector and a mating connector. The plug connector comprises a housing which has a plug-in side, a rear side and a base side connecting the plug-in side and the rear side. The rear side is preferably arranged opposite the plug-in side, wherein the housing may have at least one socket extending from the rear side to the plug-in side. Furthermore, the plug connector comprises a latching arm. The mating connector has a receiving space into which the plug connector can be brought at least partially in a direction of insertion into a connection position. In the connection position, the latching arm in a rest position is engaged with a latch receiver of the mating connector. In this context, "rest position" can be understood to mean that no external, in particular mechanical, force that would change the position of the latching arm is acting thereon.

The plug connector furthermore comprises a securing unit movably arranged on the base side. The securing unit is arranged between a locked position, in which the securing unit locks the latching arm in the rest position, and a release position, in which the latching arm can be moved out of its rest position. In other words, in the securing position, the securing unit prevents the latching arm from being moved out of its rest position. In the release position, the latching arm may preferably be moved out of the rest position at least to such an extent that in the connection position, the latching arm may be moved out of the latch receiver.

The securing unit has a base part and a securing arm extending away from the base part toward the plug-in side. The securing arm has a stop surface which, in the release position, abuts against a stopper element arranged on the base side of the housing, so that a movement of the securing unit into the locked position is blocked. The securing unit is preferably located outside the connection position in the release position. Furthermore, the securing arm comprises a deflection chamfer at an end facing away from the base part. The mating connector comprises at least one counterstop element. If the plug connector is introduced into the receiving space in a direction of insertion, the counterstop element strikes the deflection chamfer, wherein the securing arm is deflected perpendicularly to the direction of insertion and in parallel to the base side. When the plug connector is brought into the connection position, the securing arm is deflected to such an extent by means of the counterstop element that the stop surface is arranged at an offset from the stopper element and the securing unit can be moved into the locked position. The securing arm is preferably deflected in such a way that the securing arm slides due to the deflection chamfer on the counterstop element when the plug connector is inserted into the receiving space, and is deflected by elastic deformation.

The structure according to an embodiment of the invention makes it possible to provide a connecting device with the aid of which at least one cable can be electrically conductively connected to an electrical component, wherein an undesired release of the connection is additionally prevented by a plug connector position securing system. At the same time, the degree of complexity of the connecting device can be kept low, which reduces the manufacturing effort and thus the costs incurred for the connecting device, without having to accept disadvantages in the functionality of the connecting device.

The base side may be divided into a first and a second base-side section by a central plane which extends centrally from the rear side to the plug-in side and perpendicularly to the base side. However, the central plane is not a concrete plane but rather an imaginary, in particular mathematical, plane. In this context, "central" can be understood to mean that the central plane between the rear side and the plug-in side has, in particular over the entire length of the base side, a distance which the central plane has from a first base-side outer edge and which is equal to the distance which the central plane has from a second base-side outer edge. The first and the second base-side outer edges may advantageously be arranged symmetrically as a mirror image of one another, wherein the central plane particularly preferably represents the mirror plane. It is preferred that a movement axis along which the securing unit may be moved between the release position and the locked position is arranged in parallel to the central plane. Furthermore, it is preferred that the securing arm is deflected toward the central plane by the counterstop element. In the release position, the securing arm may be arranged completely in the second base-side section, wherein in the locked position, the securing arm is arranged at least for the most part in the base-side section.

The latching arm may preferably be connected to the base side in the region of the plug-in side and may extend at a distance from the base side along the base side, in particular in parallel to the central plane, toward the rear side. The distance of the latching arm may increase in this case starting from the plug-in side to the rear side. The latching arm may be formed in one piece and/or integrally with the housing. At an end facing away from the plug-in side, the latching arm may have an actuating section which at least for the most part is arranged in the first base-side section. Depending on the embodiment, it is also possible for the arm to be arranged completely in the first base-side section. In this context, an "actuating section" can be understood to mean a section of the latching arm which is designed to move the latching arm out of its rest position, in particular by pressing or pulling, in order, for example, to release the engagement of the latching arm of the plug connector in the latch receiver of the mating connector.

The housing may have a securing bracket which spans the actuating section of the latching arm. At this point, it is preferred for the securing bracket to span only a sub-section of the actuating section. The securing bracket may, for example, extend from the first base-side outer edge to the second base-side outer edge. Furthermore, the securing bracket is preferably formed integrally and/or in one piece with the housing. Furthermore, a passage through which at least the actuating section of the latching arm is guided is preferably enclosed by the base side and the securing bracket. Furthermore, the securing unit may also be guided through the passage. At this point, however, it is particularly preferred that, at least in the release position, the securing arm is guided through the passage, but the base part is arranged outside the passage.

Furthermore, the securing unit may have a latch arranged between the actuating section and the securing bracket in the locked position. The latch is preferably connected to the base part via a cover element which covers the actuating section at least in the locked position. It is furthermore preferred that the actuating section is arranged at least in sections between the base part and the cover element, at least in the locked position. In a further preferred embodiment, the actuating section is arranged in the release position at least in sections between the latch and the base side, wherein the actuating section may particularly preferably be actuatable indirectly via the latch, for example, in that the latch is pressed toward the base side, and as a result, the latch exerts a force onto the actuating section and the actuating section is also pressed toward the base side.

On a side facing away from the base side, the securing arm may comprise a retaining element which strikes a side wall of the securing bracket at least in the release position. The side wall preferably runs at an angle between 60 and 120 degrees, more preferably perpendicularly, to the central plane. On a side facing the side wall, the retaining element may have an abutting surface that runs approximately in parallel to the side wall. On a side facing away from the side wall, the retaining element may have a first lead-in chamfer. Moreover, on a side facing away from the retaining element, the side wall may comprise a second lead-in chamfer complementary to the first lead-in chamfer. By means of the first and second lead-in chamfers, the securing arm with the retaining element may be guided past the side wall when the securing arm is pushed through the passage during assembly.

The stopper element and at least the majority of the securing arm may be arranged in the second base-side section. At this point, it is particularly preferred that at least the actuating section of the latching arm is arranged for the most part or even completely in the first base-side section and the securing arm is arranged for the most part or even completely in the second base-side section. Furthermore, it is particularly preferred that the stopper element and the actuating section are arranged at an offset from one another with respect to the central plane. "Offset" in this context can be understood to mean that there is no connecting line running in parallel to the central plane between the stopper element and the actuating section.

In the release position, the securing arm, together with the central plane, may enclose an angle, in particular an acute angle, al which is greater than an angle $\alpha 2$ which the securing arm, in the locked position, encloses with the central plane. Both the angle $\alpha 1$ and the angle $\alpha 2$ preferably have the same apex. Furthermore, it is preferred that the angles $\alpha 1$ and $\alpha 2$ open toward the plug-in side. In addition, it is preferred that the securing arm extends in parallel to the latching arm and/or to the central plane in the locked position. Furthermore, the deflection chamfer and the central plane may enclose, in particular in the locked position, an acute angle $\beta$ which opens toward the rear side.

The securing arm may be arranged at least in sections between the latching arm and the base side. In this case, the securing arm, both in the release position and in the locked position, may be arranged at least in sections between the base side and the latching arm. In particular, in the locked position, it is particularly preferred that the deflection chamfer is completely arranged between the latching arm and the base side.

The latching arm may have a protrusion at least in sections on a side facing the securing arm in a region in which the securing arm is arranged between the latching arm and the base side. If the securing arm has a retaining element, the retaining element may, at least in the locked position, be arranged at least partially in the protrusion.

In the locked position, the latching arm may rest on the base part at least in regions. The latching arm preferably rests on the base part with the actuating section. In addition, it is preferred that the latching arm does not touch the securing arm in the release position or in the locked position.

The securing unit may have at least one latching hook and the housing may comprise at least one first opening and at least one second opening, wherein the latching hook engages in the first opening in the release position and in the second opening in the locked position. The latching hook preferably holds the securing unit fixed in the release position or locked position by the engagement in the first or the second opening. At this point, it is particularly preferred that the latching hook is arranged on a side of the base part facing the base side. It is furthermore preferred that the securing unit has at least two latching hooks, two first openings and two second openings, each of which is arranged symmetrically as a mirror image of one another, wherein the central plane preferably represents the plane of symmetry. Furthermore, the at least one first opening and the at least one second opening may be arranged one behind the other along in parallel to the main plane.

The stopper element may have a counterstop surface against which the stop surface at least partially abuts in the release position. The counterstop surface may enclose an acute or right angle $\gamma$ with the base side, wherein the angle $\gamma$ may open toward the rear side. Furthermore, it is preferred that the counterstop surface is arranged on a side of the stopper element facing away from the plug-in side and facing toward the rear side. If the angle $\gamma$ is designed as an acute angle, the angle $\gamma$ preferably has an angular dimension of 45 degrees to 89 degrees, more preferably 60 degrees to 89 degrees. Furthermore, it is particularly advantageous if the stop surface is formed at a corresponding angle to the counterstop surface so that, in the release position, the stop surface preferably abuts against the counterstop surface in a planar manner.

FIG. 1 shows a first embodiment of a plug connector 2 of a connecting device according to the invention in a three-dimensional exploded view. The plug connector 2 has a housing 4 with a plug-in side 5, a rear side 6 and a base side 7 connecting the rear side 6 and the plug-in side 5. In the present case, four parallel sockets 35 extend from the rear side 6 to the plug-in side 5. Four cables may be introduced into the sockets 35 via the rear side 6, which cables may be connected via the plug-in side 5 to a further electrical component. On the base side 7, the housing 4 has a latching arm 8. The latching arm 8 is formed in one piece and integrally with the housing 4 and is connected to the housing 4 in the region of the plug-in side 5. The base side is delimited by a first base-side outer edge 32 and a second base-side outer edge 33 which extend between the rear side 6 and the plug-in side. Furthermore, the housing 4 has a securing bracket 24 which is arranged on the base side 7 and extends from the first base-side outer edge 32 to the second base-side outer edge 33. Together with the base side 7, the securing bracket 24 encloses a passage through which the latching arm 8 projects in part with an actuating section 23. Furthermore, a stopper element 15 is arranged on the base side 7. In the present embodiment, the stopper element 15 is arranged between the latching arm 8 and the base side 7.

Figure 11:
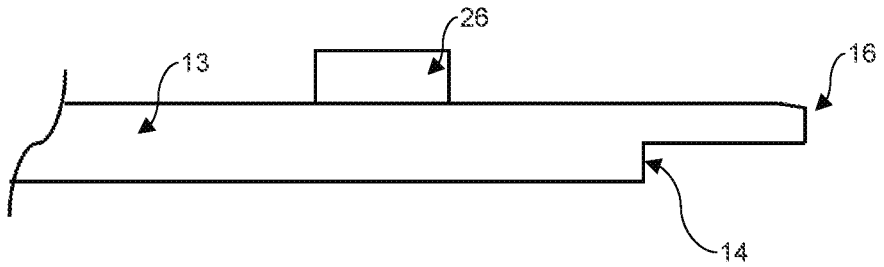
FIG. 11 a partial side view of the end of the securing arm 13 according to the first embodiment.

The plug connector 2 furthermore has a securing unit 11 which may be positioned on the base side 7 of the housing 4. The securing unit 11 consists of a base part 12 from which a securing arm 13 extends. The securing arm 13 has a stop surface 14 at an end 16 facing away from the base part 12. If the securing unit 11 is positioned on the base side 7 of the housing 4 in a release position, the stop surface 14 is arranged on a side of the securing arm 13 facing the base side 7. Furthermore, the securing arm 13 has a deflection chamfer 17 at the end 16 that faces away from the base part 12. The securing unit 11 may be moved between the release position previously mentioned and a locked position on the base side 7 of the housing 4. In order to hold the securing unit 11 in the respective positions, the securing unit 11 has two latching hooks 29 on the base part 12 on a side facing the base side 4 when the securing unit 11 is positioned on the base side 7. FIG. 11 shows a side view of the end 16 of the securing arm 13 viewed on a side opposite to the deflection chamfer 17, and illustrates the stop surface 14 arranged on the side of the securing arm 13 which will face the base side 7 in the release position.

Figure 2:
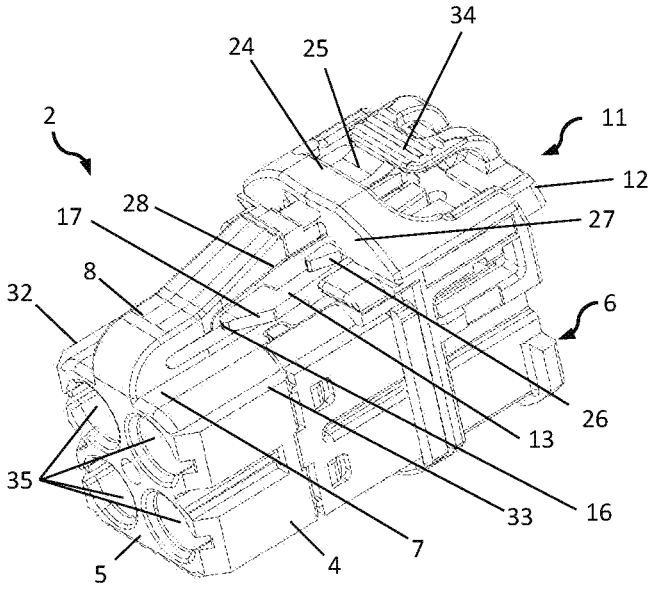
FIG. 2 a three-dimensional representation of the first embodiment of the plug connector of the connecting device according to the invention.

FIG. 2 shows a three-dimensional representation of the first embodiment, wherein the securing unit 11 is arranged on the base side 7 of the housing 4 in the release position. In order to prevent the securing unit 11 from moving out of the release position by itself, the securing arm 13 has a retaining element 26 on a side facing away from the base side 7, which retaining element 26 strikes a side wall 27 of the securing bracket 24. The securing unit 11 may therefore only be moved toward the rear side 6 to the point at which the retaining element 26 strikes the side wall 27. The securing unit 11 furthermore has a latch 25 which is connected to the base part 13 via a cover element 34. In the present embodiment, the latch 25, in both the release position and the locked position, is arranged at least in part between the securing bracket 24 and the latching arm 8.

Figure 3:
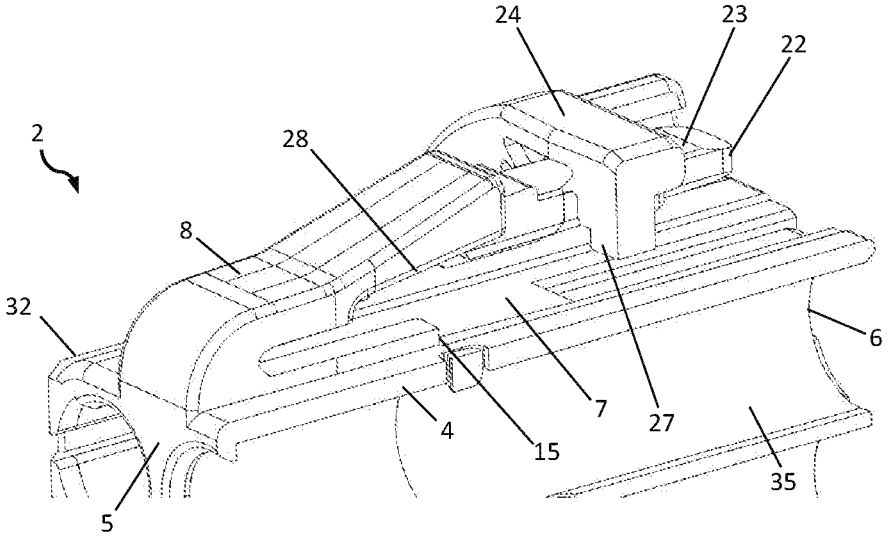
FIG. 3 a three-dimensional representation of the first embodiment of the plug connector of the connecting device according to the invention with a sectional view.

FIG. 3 shows an enlarged view of the first embodiment in a three-dimensional view with a sectional view perpendicular to the base side 7. The latching arm 8 has a protrusion 28 on a side facing the base side 7. The protrusion 28 ensures that the securing unit 11 can be moved between the release position and the locked position without limiting the freedom of movement of the securing unit 11. The part of the actuating section 23 which is arranged at an end 22 of the latching arm 8 facing away from the plug-in side 5 may be used to operate the latching arm 8. In the present embodiment, this is done by manually pressing the actuating section 23 toward the base side 7.

Figure 4:
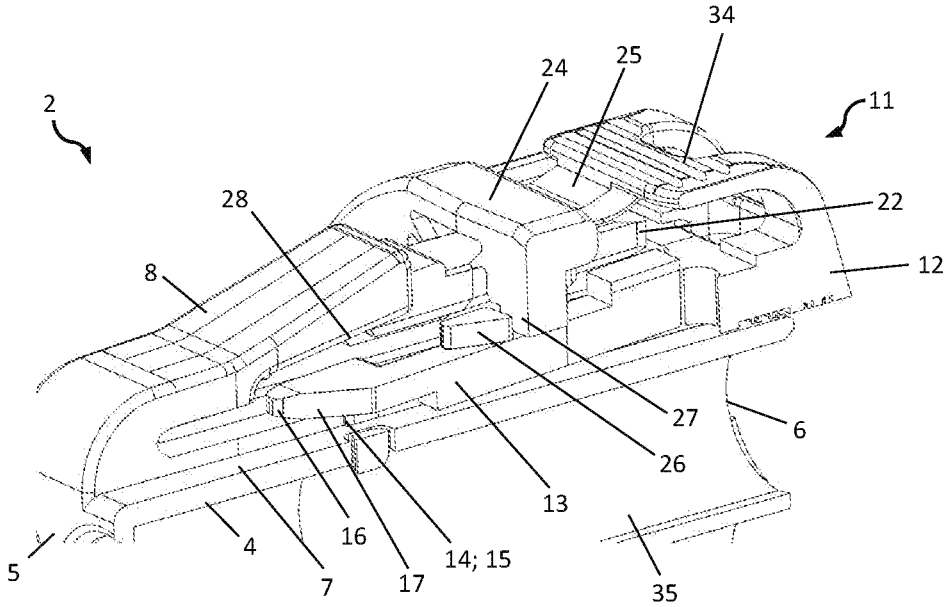
FIG. 4 a three-dimensional representation of the first embodiment of the plug connector of the connecting device according to the invention with a securing unit.

FIG. 4 shows the three-dimensional representation of the first embodiment with a sectional view perpendicular to the base side 7 according to FIG. 3, wherein the securing unit 11 in the release position is arranged on the base side 7 of the housing 4. In order to ensure that the securing unit 11 does not move out of the release position toward the plug-in side 5 by itself, the stop surface 14 abuts against the stopper element 15. Furthermore, the latch 25 of the securing unit 11 is located between the securing bracket 24 and the actuating section 23 of the latching arm 8. In the present embodiment, the latching arm 8 is thus not moved, for example, by a fitter directly pressing the actuating section 23 but by the fitter pressing the cover element 34 toward the base side 7. Due to the elastic deformation of the cover element 34, the latch 25 presses against the latching arm 8 so that the latching arm 8 may be operated indirectly via the securing unit 11.

Figure 5:
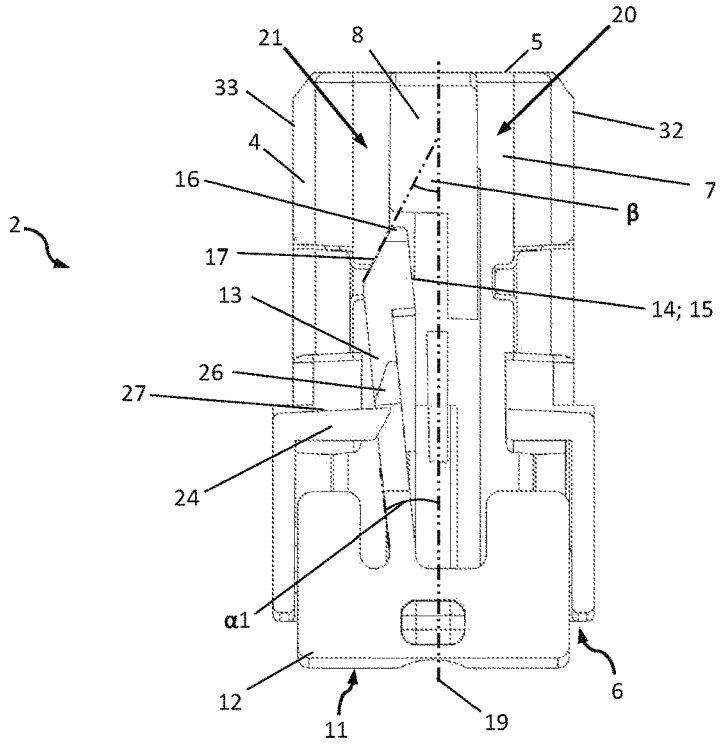
FIG. 5 a plan view of a base side of the plug connector of the connecting device according to the invention according to the first embodiment.

FIG. 5 shows a plan view of the base side 7 of the plug connector 2 according to the first embodiment. In the representation shown, the securing unit 11 is in the release position. The base side 7 is divided by a central plane 19 into a first base-side section 20 and a base-side section 21. In the present embodiment, the base-side sections 20, 21 are delimited by the central plane and the respective base-side outer edge 32, 33. While the latching arm 8 in the region of the plug-in side 5 is still arranged substantially centrally to the central plane 19, the actuating section 23 extends for the most part in the first base-side section 20. In the release position, the securing arm 13 is arranged completely in the second base-side section 21. In the release position, the securing arm 13 and the central plane 19 enclose an acute angle $\alpha$ greater than 0 degrees. Furthermore, the central plane 19 encloses an acute angle $\beta$ with the deflection chamfer 17.

Figure 6:
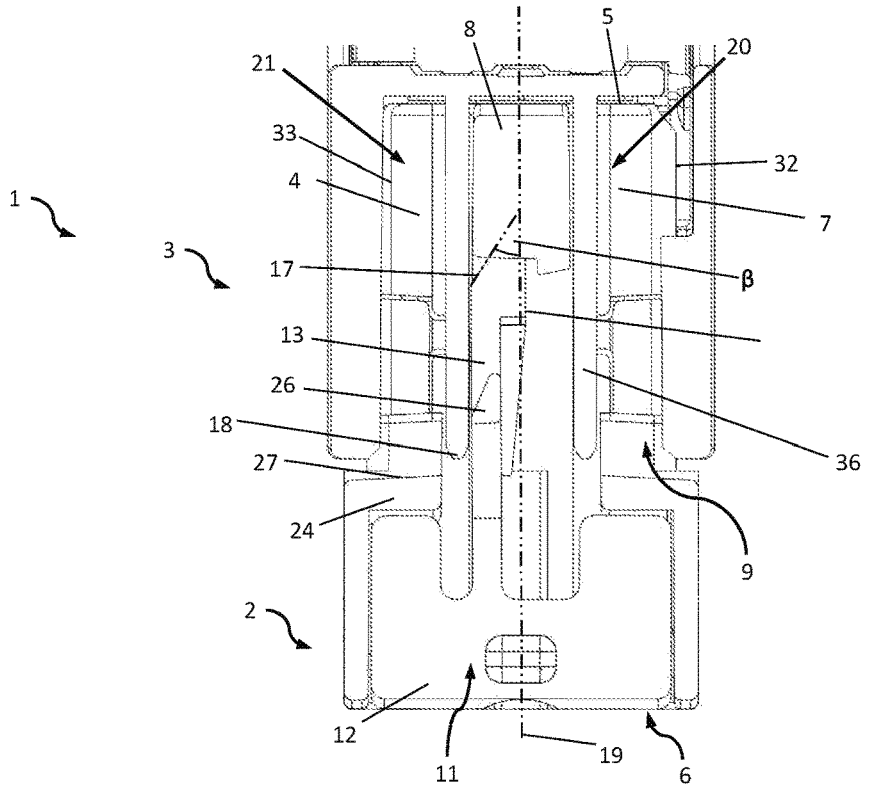
FIG. 6 a plan view of a base side of a complete connecting device according to the invention according to the first embodiment.

FIG. 6 shows the connecting device 1 in a plan view of the base side 7 of the plug connector 2, wherein the plug connector 2 is arranged in a connection position inside a receiving space 9 of a mating connector 3. The securing unit 11 is in the locked position. In its receiving space 9, the mating connector 3 has a counterstop element 18 which runs in the form of a web inside the receiving space 9. In a method step, the plug connector 2 is moved into the receiving space 9 of the mating connector 3. Before reaching the connection position, the securing arm 13 is deflected toward the central plane by the counterstop element 18. This is done by the deflection chamfer 17 striking the counterstop element 18 when the plug connector 2 is introduced into the receiving space 9, wherein as a result of the deflection chamfer 17, a force component acts on the securing arm 13 toward the central plane 19 and deflects the securing arm 13. In the present embodiment, the deflection takes place by an elastic deformation of the securing arm 13 which consists of a thermoplastic material. In order to facilitate a deflection of the securing arm 13 and to avoid tilting, the counterstop element 18 is also chamfered. In order to prevent the entire plug connector 3 from being offset perpendicularly to the central plane 19 by the force component acting toward the central plane, the mating connector 3 has an additional abutment 36 in the receiving space 9. The abutment 36 is also designed in the form of a web, wherein the latching arm 8 is guided between the web formed by the counterstop element 18 and the web formed by the abutment 36. Said guiding deflects the securing arm 13 but not the remaining plug connector 3. Both the angle $\beta$, which the central plane 19 encloses with the deflection chamfer 17, and the angle $\alpha$, which the securing arm encloses with the central plane 19, are smaller in the locked position than in the release position, wherein the angle $\alpha$ is not shown in FIG. 6 since it is approximately 0 degrees in the locked position in the present embodiment.

Figure 7:
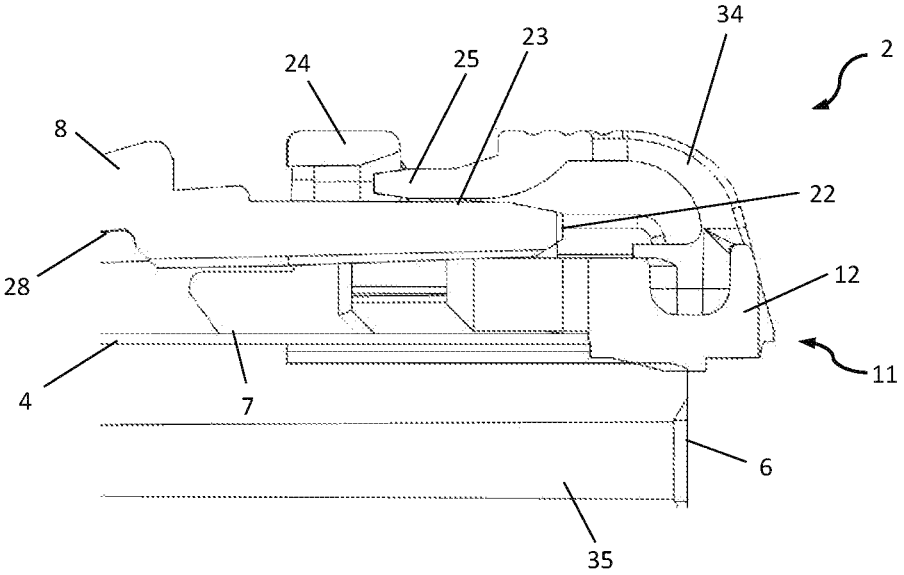
FIG. 7 a sectional view of the plug connector of the connecting device according to the invention in the region of the securing unit in a release position according to the first embodiment.

FIG. 7 shows a sectional view of the plug connector 2 according to the first embodiment in the region of the securing unit 11, wherein the sectional plane runs in parallel to the central plane 19. The securing unit 11 is in the release position. Although the latch 25 is in part arranged between the securing bracket 24 and the actuating section 23, the latching arm 8 is in a rest position. In the release position, the base part 12 is arranged at an offset from the latching arm 8 toward the rear side 6 so that the end 23 of the latching arm 8 can be guided past the base part 12 toward the base side 7.

Figure 8:
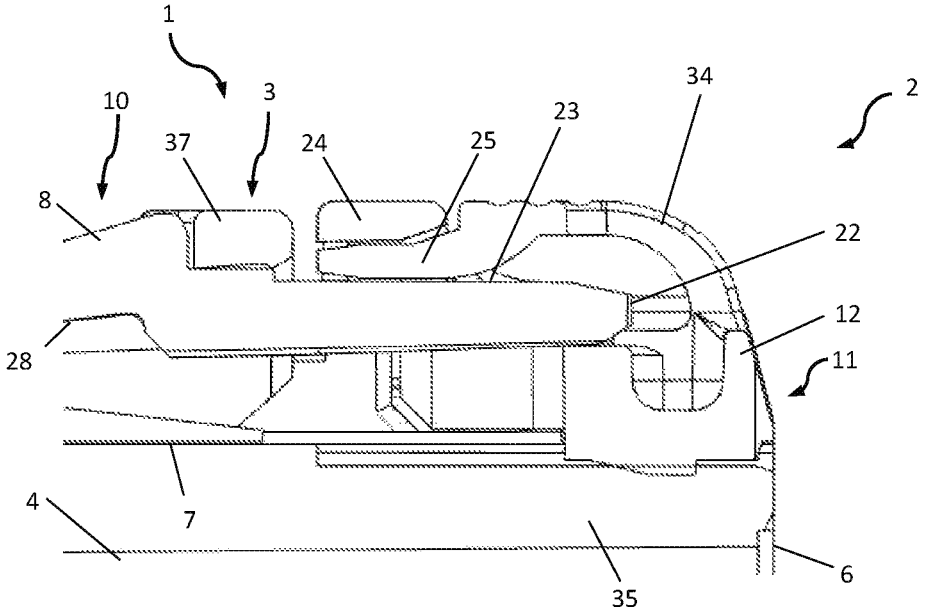
FIG. 8 a sectional view of the plug connector of the connecting device according to the invention in the region of the securing unit in a locked position according to the first embodiment.

FIG. 8 shows a sectional view of the plug connector 2 according to the first embodiment in a connection position, wherein the securing unit 11 is arranged in the locked position. The latching arm 8 is engaged with a latch receiver 10 of the mating connector 3. For this purpose, the mating connector 3 has a bracket past which the latching arm 8 is guided. In the connection position, the latching arm 8 is also in the rest position, wherein the latching arm 8 left the rest position as the latching arm 8, in a method step, was guided past the bracket 37 by the introduction of the plug connector 3 into the receiving space of the mating connector 3. In the locked position, the latching arm 8 rests with its end 22 on the base part 12 of the securing unit so that the latching arm 8 cannot be moved toward the base side 7. Furthermore, the latch 25 is completely arranged between the securing bracket 24 and the actuating section 23.

Figure 9:
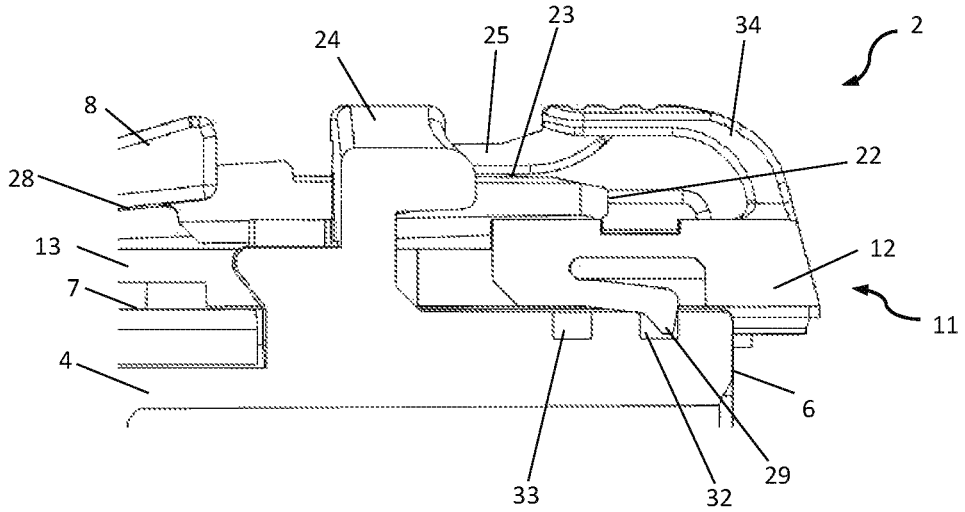
FIG. 9 a further sectional view of the plug connector of the connecting device according to the invention in the region of the securing unit in a release position according to the first embodiment.

FIG. 9 shows a sectional view of the plug connector 2 according to the first embodiment, wherein the securing unit is arranged in the release position. The sectional plane runs in parallel to the central plane and through the latching hook 29 of the securing unit 11. In the present embodiment, the securing unit 11 has two latching hooks 29 on the side of the base part 12 facing the base side 7. The one latching hook 29 shown is arranged in a first opening 32. The first opening 32 is introduced into the base side 7 of the housing 4. The engagement of the latching hook 29 in the first opening 32 prevents the securing unit 11 from independently moving out of the release position.

Figure 10:
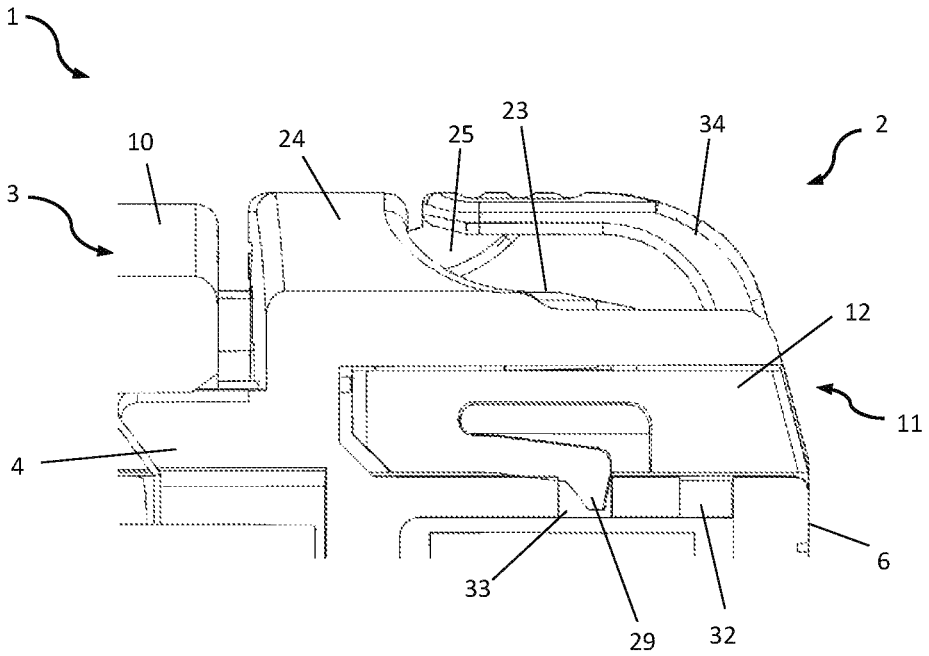
FIG. 10 a further sectional view of the plug connector of the connecting device according to the invention in the region of the securing unit in a locked position according to the first embodiment.

FIG. 10 shows a further sectional view of the plug connector 2 according to the first embodiment, wherein the securing unit is arranged in the locked position. The sectional plane runs in parallel to the central plane and through the latching hook 29 of the securing unit 11. In the locked state, the latching hook 29 shown engages in a second opening 33. The second opening 33 is also introduced into the base side 7 of the housing 4. The engagement of the latching hook 29 in the second opening 33 prevents the securing unit 11 from independently moving out of the locked position. The first and the second opening are arranged in the base side 7 one behind the other in relation to a direction parallel to the central plane. Since the base part 12 in the present embodiment comprises two latching hooks 29, the housing 4 also has two first openings 32 and two second openings 33 in each case.

The explanations made with reference to the figures are to be understood purely by way of example and not by way of limitation.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Connecting device
2 Plug connector
3 Mating connector
4 Housing
5 Plug-in side
6 Rear side
7 Base side
8 Latching arm
9 Receiving space
10 Latch receiver
11 Securing unit
12 Base part
13 Securing arm
14 Stop surface
15 Stopper element
16 End (securing arm)
17 Deflection chamfer
18 Counterstop element
19 Central plane
20 First base-side section
21 Second base-side section
22 End (latching arm)
23 Actuating section
24 Securing bracket
25 Latch
26 Retaining element
27 Side wall
28 Protrusion
29 Latching hook
30 First opening
31 Second opening
32 First base-side outer edge
33 Second base-side outer edge
34 Cover element
35 Socket
36 Abutment
37 Bracket

What is claimed is:

1. A connecting device comprising:

a plug connector having a housing which has a plug-in side, a rear side and a base side connecting the plug-in side and the rear side, and a latching arm; and a mating connector having a receiving space, wherein, in a connection position, the plug connector is at least partially received, in a direction of insertion, in the receiving space of the mating connector, wherein, in the connection position, the latching arm, in a rest position, is engaged with a latch receiver of the mating connector, wherein the plug connector has a securing unit which is movably arranged on the base side between a locked position, in which the securing unit locks the latching arm in the rest position, and a release position, in which the latching arm is movable out of the rest position, the securing unit comprising:

a base part and a securing arm extending away from the base part toward the plug-in side;

a stop surface which, in the release position, abuts against a stopper element arranged on the base side of the housing so that a movement of the securing unit into the locked position is blocked; and a deflection chamfer at an end facing away from the base part, wherein the mating connector has at least one counterstop element which is configured such that, when the plug connector is introduced into the receiving space, the at least one counterstop element strikes the deflection chamfer and deflects the securing arm perpendicularly to the direction of insertion and in parallel to the base side so that, in the connection position, the stop surface is arranged at an offset from the stopper element and the securing unit is movable into the locked position, wherein the base side is divided into a first and a second base-side section by a central plane which extends centrally from the rear side to the plug-in side and perpendicularly to the base side, and wherein the stopper element and at least a majority of the securing arm are arranged at the second base-side.

2. The connecting device according to claim 1, wherein the latching arm is connected to the base side in a region of the plug-in side, extends at a distance from the base side along the base side, which is in parallel to the central plane, toward the rear side and, at an end facing away from the plug-in side, has an actuating section.

3. The connecting device according to claim 2, wherein the housing has a securing bracket which spans the actuating section.

4. The connecting device according to claim 3, wherein the securing unit has a latch which, in the locked position, is arranged between the actuating section and the securing bracket.

5. The connecting device according to claim 3, wherein, on a side facing away from the base side, the securing arm has a retaining element which strikes a side wall of the securing bracket at least in the release position.

6. The connecting device according to claim 1, wherein the stopper element and the actuating section are arranged at an offset from one another with respect to the central plane.

7. The connecting arrangement according to claim 1, wherein, in the release position, the securing arm encloses with the central plane an acute angle which is greater than an angle which the securing arm encloses with the central plane in the locked position.

8. The connecting device according to claim 1, wherein the deflection chamfer and the central plane enclose an acute angle which opens toward the rear side.

9. The connecting device according to claim 1, wherein the securing arm is arranged at least in sections between the latching arm and the base side.

10. The connecting device according to claim 9, wherein the securing arm has, in a region in which the securing arm is arranged between the latching arm and the base side, a retaining element which protrudes from the securing arm.

11. The connecting device according to claim 1, wherein, in the locked position, the latching arm rests at least in regions on the base part.

12. The connecting device according to claim 1, wherein the securing unit comprises at least one latching hook and the housing comprises at least one first opening and at least one second opening, wherein the latching hook engages in the first opening in the release position and in the second opening in the locked position.

13. The connecting device according to claim 1, wherein the stopper element has a counterstop surface against which the stop surface at least partially abuts in the release position, wherein the counterstop surface encloses an acute or right angle with the base side and the angle opens toward the rear side.

14. The connecting device according to claim 1, wherein the securing unit includes only one securing arm so as to provide for an asymmetric arrangement of the securing arm with respect to the central plane.

15. A connecting device comprising:

a plug connector having a housing which has a plug-in side, a rear side and a base side connecting the plug-in side and the rear side, and a latching arm; and a mating connector having a receiving space, wherein, in a connection position, the plug connector is at least partially received, in a direction of insertion, in the receiving space of the mating connector, wherein, in the connection position, the latching arm, in a rest position, is engaged with a latch receiver of the mating connector, wherein the plug connector has a securing unit which is movably arranged on the base side between a locked position, in which the securing unit locks the latching arm in the rest position, and a release position, in which the latching arm is movable out of the rest position, the securing unit comprising:

a base part and a securing arm extending away from the base part toward the plug-in side;

a stop surface which, in the release position, abuts against a stopper element arranged on the base side of the housing so that a movement of the securing unit into the locked position is blocked; and a deflection chamfer at an end facing away from the base part, wherein the mating connector has at least one counterstop element which is configured such that, when the plug connector is introduced into the receiving space, the at least one counterstop element strikes the deflection chamfer and deflects the securing arm perpendicularly to the direction of insertion and in parallel to the base side so that, in the connection position, the stop surface is arranged at an offset from the stopper element and the securing unit is movable into the locked position, wherein the base side is divided into a first and a second base-side section by a central plane which extends centrally from the rear side to the plug-in side and perpendicularly to the base side, wherein the latching arm is connected to the base side in a region of the plug-in side, extends at a distance from the base side along the base side, which is in parallel to the central plane, toward the rear side and, at an end facing away from the plug-in side, has an actuating section, wherein the housing has a securing bracket which spans the actuating section, and wherein at least one of:

the securing unit has a latch which, in the locked position, is arranged between the actuating section and the securing bracket, or on a side facing away from the base side, the securing arm has a retaining element which strikes a side wall of the securing bracket at least in the release position.

16. The connecting device according to claim 15, wherein the securing unit has a latch which, in the locked position, is arranged between the actuating section and the securing bracket.

17. The connecting device according to claim 15, wherein, on a side facing away from the base side, the securing arm has a retaining element which strikes a side wall of the securing bracket at least in the release position.

18. A connecting device comprising:

a plug connector having a housing which has a plug-in side, a rear side and a base side connecting the plug-in side and the rear side, and a latching arm; and a mating connector having a receiving space, wherein, in a connection position, the plug connector is at least partially received, in a direction of insertion, in the receiving space of the mating connector, wherein, in the connection position, the latching arm, in a rest position, is engaged with a latch receiver of the mating connector, wherein the plug connector has a securing unit which is movably arranged on the base side between a locked position, in which the securing unit locks the latching arm in the rest position, and a release position, in which the latching arm is movable out of the rest position, the securing unit comprising:

a base part and a securing arm extending away from the base part toward the plug-in side;

a stop surface which, in the release position, abuts against a stopper element arranged on the base side of the housing so that a movement of the securing unit into the locked position is blocked; and a deflection chamfer at an end facing away from the base part, wherein the mating connector has at least one counterstop element which is configured such that, when the plug connector is introduced into the receiving space, the at least one counterstop element strikes the deflection chamfer and deflects the securing arm perpendicularly to the direction of insertion and in parallel to the base side so that, in the connection position, the stop surface is arranged at an offset from the stopper element and the securing unit is movable into the locked position, and wherein the securing unit comprises at least one latching hook and the housing comprises at least one first opening and at least one second opening, wherein the latching hook engages in the first opening in the release position and in the second opening in the locked position.

* * * * *